United States Patent [19]

Fuller

[11] Patent Number: 4,685,410

[45] Date of Patent: Aug. 11, 1987

[54] WING SAIL

[76] Inventor: Robert R. Fuller, P.O. Box 383, 119 Tea Rock La., Marshfield, Mass. 02050

[21] Appl. No.: 720,958

[22] Filed: Apr. 8, 1985

[51] Int. Cl.[4] ..... B63H 9/06

[52] U.S. Cl. ..... 114/102; 114/103; 114/39; 244/218

[58] Field of Search ..... 114/39.1, 90, 102, 103, 114/104, 105; 244/46, 48, 219, 49, 218

[56] References Cited

U.S. PATENT DOCUMENTS

| | | | |
|---|---|---|---|
| 3,298,346 | 1/1967 | Cochran | 114/103 |
| 3,580,203 | 5/1971 | Martin | 114/39 |
| 3,802,366 | 4/1974 | Mankawich | 114/39 |
| 4,064,821 | 12/1977 | Roberts, Jr. et al. | 114/102 |
| 4,261,276 | 4/1981 | Darzinskis | 114/104 |
| 4,341,176 | 7/1982 | Orrison | 114/102 |
| 4,386,574 | 6/1983 | Riolland | 114/103 |
| 4,388,888 | 6/1983 | Gushurst | 114/90 |
| 4,402,277 | 9/1983 | Wainwright | 114/103 |
| 4,432,298 | 2/1984 | Cudmore | 114/39 |
| 4,437,426 | 3/1984 | Latham | 114/103 |

FOREIGN PATENT DOCUMENTS

| | | | |
|---|---|---|---|
| 2001405 | 9/1971 | Belgium | 114/102 |
| 403416 | 11/1922 | Fed. Rep. of Germany | 114/39.1 |
| 2356426 | 5/1975 | Fed. Rep. of Germany | 114/103 |
| 1536490 | 7/1968 | France | 114/103 |

*Primary Examiner*—Joseph F. Peters, Jr.
*Assistant Examiner*—Edwin L. Swinehart
*Attorney, Agent, or Firm*—Barnes & Thornburg

[57] ABSTRACT

An airfoil sail system for a boat having a mast is disclosed. The airfoil sail system includes a front airfoil which is pivotal about an axis defined by the mast. The front airfoil has leading and trailing edges, and is generally symmetrical about a vertical plane extending between its leading and trailing edges. A rear airfoil is also provided which has leading and trailing edges. The rear airfoil is generally symmetrical about a vertical plane extending between its leading and trailing edges. A base member having a traveller is provided for operatively coupling the front and rear airfoils so that rotation of the front airfoil about its axis effects a counter-rotation of the rear airfoil to permit adjustment of the camber of the airfoil sail system.

10 Claims, 11 Drawing Figures

WING SAIL

This invention relates to sail systems for boats, and more particularly to airfoil sail systems.

Airfoil sail systems differ substantially from conventional sail systems. Conventional sail systems generally include a triangularly or quadralaterally shaped sail which is supported by a mast, and sometimes a boom. The conventional sail has a thickness generally only as thick as the cloth from which the sail is made. Example of various conventional sail systems can be seen in any issue of *Yacht Racing/Cruising* or other sailing magazine.

The sail system of the present ionvention is an airfoil sail system. Typically, an airfoil system includes an internal skeletal member or system over which a skin of Dacron, cotton, Mylar, Kelvar, or other sail cloth material is stretched. As used herein, "airfoil sail system" relates to sail systems having a cross-sectional thickness greater than that of the skin material from which they are made, and does not include conventional sail systems of the type described above.

In accordance with the present invention, an airfoil sail system for a boat having a mast is provided. The airfoil sail system comprises a front airfoil which is pivotal about an axis defined by the mast. The front airfoil has leading and trailing edges, and is generally symmetrical about a vertical plane extending between its leading and trailing edges. A rear airfoil is also provided which has leading and trailing edges. The rear airfoil is generally symmetrical about a vertical plane extending between its leading and trailing edges. An operative coupling means is provided for operatively coupling the front and rear airfoils so that rotation of the front airfoil about its axis effects a counter-rotation of the rear airfoil to permit adjustment of the camber of the airfoil sail system.

In an illustrative embodiment, each of the front and rear airfoils comprises a plurality of telescoping airfoil sections. The front and rear airfoil sections telescope to permit reefing of the front and rear airfoils.

One aspect of the present invention is that the sail system of the present invention provides front and rear, generally rigid, symmetrical airfoils. The advantages achieved by these generally rigid, symmetrical airfoils include an increase in efficiency of the sail system, simplicity of design and reduced weight.

One feature of the present invention is that an operative coupling means is provided for operatively coupling the front and rear airfoils so that rotation of the front airfoil effects a counter-rotation of the rear airfoil. This feature has the advantage of permitting the user to adjust the camber of the airfoil sail system. As used herein, the "camber of the airfoil sail system" refers to the smaller angle formed between the geometric chords of the front and rear airfoil. When the angle between the geometric chords is 180°, the camber of the sail system is at its minimum. As the angle between the geometric chord decreases from 180°, the camber of the airfoil sail system increases. By permitting the camber of the sail system to be varied, the user can better tune the sail system for different wind conditions, thus increasing the efficiency of the sail system. For example, when the boat is beating (sailing upwind) in strong winds, the camber of the sail system should be decreased to produce high lift with minimum drag. Conversely, when the boat is running (sailing downwind), the camber of the sail system should be increased to maximum lift with no regard for drag.

It is also a feature of one embodiment of te present invention that each of the front and rear airfoils comprises a plurality of telescoping airfoil sections. This feature has the advantage of making the front and rear airfoils reefable. This reefability is especially useful when sailing in strong winds. By permitting the user to reef the airfoils, the user can reduce the effective surface area of the sail system, thus depowering the sail system. In strong winds, this depowering is often necessary to enable the user to maintain control of the boat and to prevent the boat from capsizing.

Various features and advantages of the invention will become apparent to those skilled in the art upon consideration of the following detailed description of the invention. The detailed description particularly refers to the accompanying drawings, in which.

Figure 1:
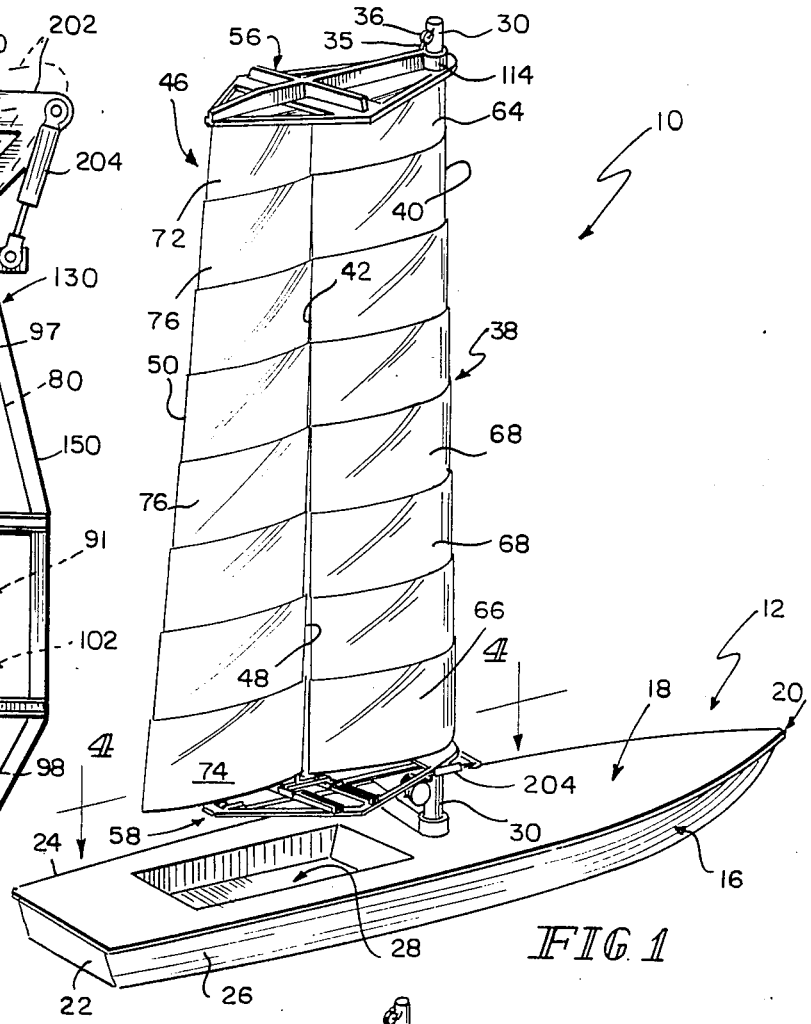
FIG. 1 is a perspective view of a boat outfitted with the airfoil sail system of the present invention, showing the airfoils in a raised position.
Figure 2:
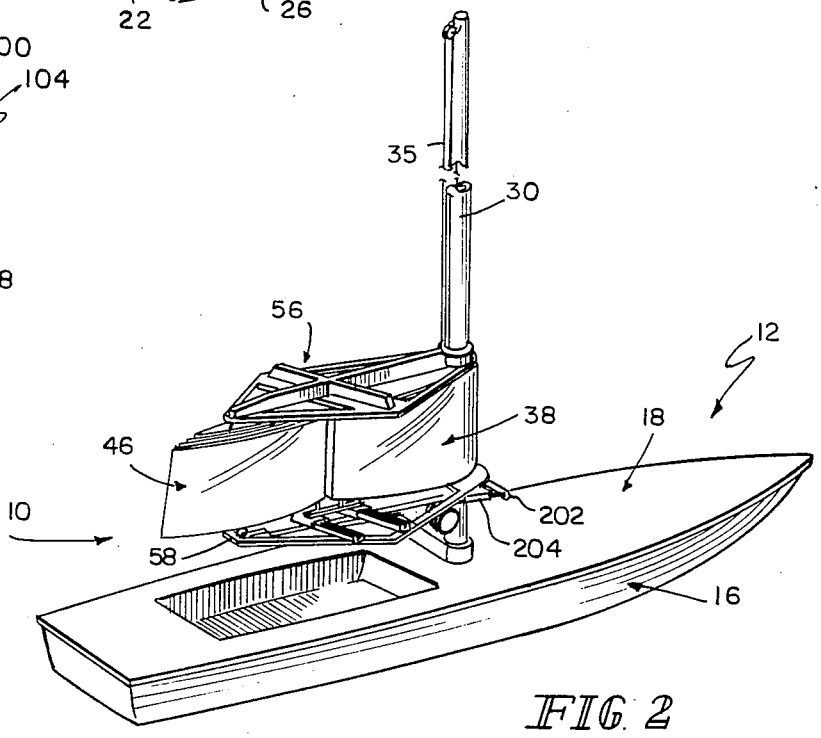
FIG. 2 is a perspective view, partly broken away, of the boat of FIG. 1 with an airfoil sail system constructed according to the present invention in a lowered position.

An airfoil sail system 10 for propelling a boat 12 is shown in FIGS. 1 and 2. The boat 12 includes a hull 16, a deck 18, a bow 20, a stern 22, a port side 24, and a starboard side 26. A cockpit or footwell 28 is provided in the boat 12 in which a sailor can sit or rest his feet while sailing the boat 12. The boat 12 also includes an upwardly extending mast 30. The mast 30 can be formed from an extruded aluminum member, and is rotatably coupled to the boat 12 so that the mast 30 can rotate, at least to a limited degree, about its longitudinal axis. The mast can be supported above the deck 18 or supported in a mast well formed in the deck 18. The mast well can be formed as part of a space frame (not shown) in the boat 12 so that the space frame (not shown) can absorb the stress transferred from the mast 30 to the boat 12.

A rudder and tiller arrangement (not shown) are provided adjacent the stern 22 of the boat 12 for permitting the user to steer the boat 12. A halyard 35 and pulley 36 arrangement is coupled to the mast 30 and airfoil sail system 10 for raising and lowering the airfoil sail system 10. As is known, a portion of the halyard 35 can run through the interior of the mast 30.

The airfoil sail system 10 includes a front airfoil 38 which surrounds the mast 30 and pivots about an axis defined by the mast 30. The front airfoil 38 includes a leading edge 40 and trailing edge 42. Additionally, the front airfoil 38 is generally symmetrical about a vertical plane extending between the leading and trailing edges 40, 42. A rear airfoil 46 is provided which also includes a leading edge 48 disposed adjacent the trailing edge 42 of the front airfoil 38, and a trailing edge 50. The rear airfoil 46 is similar to the front airfoil 38 in that it is generally symmetrical about a vertical plane extending between its leading and its trailing edges 48, 50. The front airfoil 38 illustratively has a generally thicker profile than the rear airfoil 46. The front and rear airfoils 38, 46 are operatively coupled together so that rotation of the front airfoil 38 about its axis effects a counter-rotation of the rear airfoil 46.

A top member 56 is dispsed above the front and rear airfoils 38, 46, and a base member 58 is disposed generally beneath the front and rear airfoils 38, 46. Both the top and base members 56, 58 are rotatably coupled to the mast 30.

The front airfoil 38 comprises a plurality of telescoping airfoil sections including a top airfoil section 64 disposed adjacent the top member 56, a bottom airfoil section 66 disposed adjacent base member 58, and a plurality of intermediate airfoil sections 68 disposed between the top and bottom airfoil sections 64, 66, respectively. Similarly, the rear airfoil 46 comprises a plurality of telescoping airfoil sections including a top airfoil section 72 disposed adjacent the top member 56, a bottom airfoil section 74 disposed adjacent the base member 58, and a plurality of intermediate airfoil sections 76 disposed between the top and bottom airfoil sections 72, 74, respectively.

As best shown in FIG. 2, when the front and rear airfoils 38, 46 are lowered, the top airfoil sections 64, 72, are disposed interiorly of the intermediate airfoil sections 68, 76 of the respective front and rear airfoils 38, 46. Additionally, intermediate airfoil sections 68, 76 are disposed interiorly of the bottom airfoil sections 66, 74.

Although the front and rear airfoils 38, 46 are shown in their fully lowered positions in FIG. 2, the airfoils 38, 46 can be in a partially raised position wherein the top member 56, top airfoil sections 64, 72 and intermediate airfoil sections 68, 76 are disposed at some partially raised positions on the mast 30 between the fully raised position shown in FIG. 1, and the fully lowered position shown in FIG. 2. When the top member 56, top airfoil sections 64, 72 and intermediate airfoil sections 68, 76 are in such a partially raised position, only portions of the full surface areas of the front and rear airfoils 38, 46 are exposed to the wind.

Adjusting the vertical positions of the airfoils 38, 46, on the mast 30 is commonly referred to as "reefing." Reefing is often desirable when the boat 12 is being sailed in strong winds. In such strong winds, the boat 12 can be overpowered by the strength of the wind. By reefing the airfoil sail system 10, the sailor can depower the sail and maintain control of the boat 12. The ability of a boat 12's sails to reef is especially important for ocean-going sailboats which often sail far from shore.

The structural details of the airfoil sail system 10 are best shown in FIGS. 3–6. Each of the airfoil sections 64, 66, 68 of the front airfoil 38 includes a front airfoil frame member 80 disposed adjacent the bottom of the respective airfoil sections 64, 66, 68. A front airfoil frame member 80 is also provided adjacent the top edge of the top front airfoil section 64. The front airfoil frame members 80 impart an airfoil profile to the sail covering material 82. Sail covering material 82 surrounds, and is attached to, each front airfoil frame member 80.

Each front airfoil frame member 80 includes a forward portion 83 (FIG. 6) having a somewhat eliptical opening 84 with flat opposed surfaces 85. Brackets 86 are mounted on surfaces 85 and are configured to receive mast track members 88, which are fixed to the mast 30. The brackets 86 slide up and down the mast track members 88 when the front airfoil frame members 80 are being hoisted up and lowered down the mast 30 during the raising and lowering of the front airfoil 38. The engagement between the brackets 86 and mast track members 88 also fixes the front airfoil frame members 80 against rotation relative to the mast 30 so that rotation of the mast 30 rotates the front airfoil frame members 80, and hence the front airfoil 38. An interior restraint line bracket 90 is mounted to a rearwardly facing surface 91 of the forward portion 83 of each of the front airfoil frame members 80, for providing a means of restraint, and preventing the airfoil sections from telescoping beyond engagement.

Figure 4:
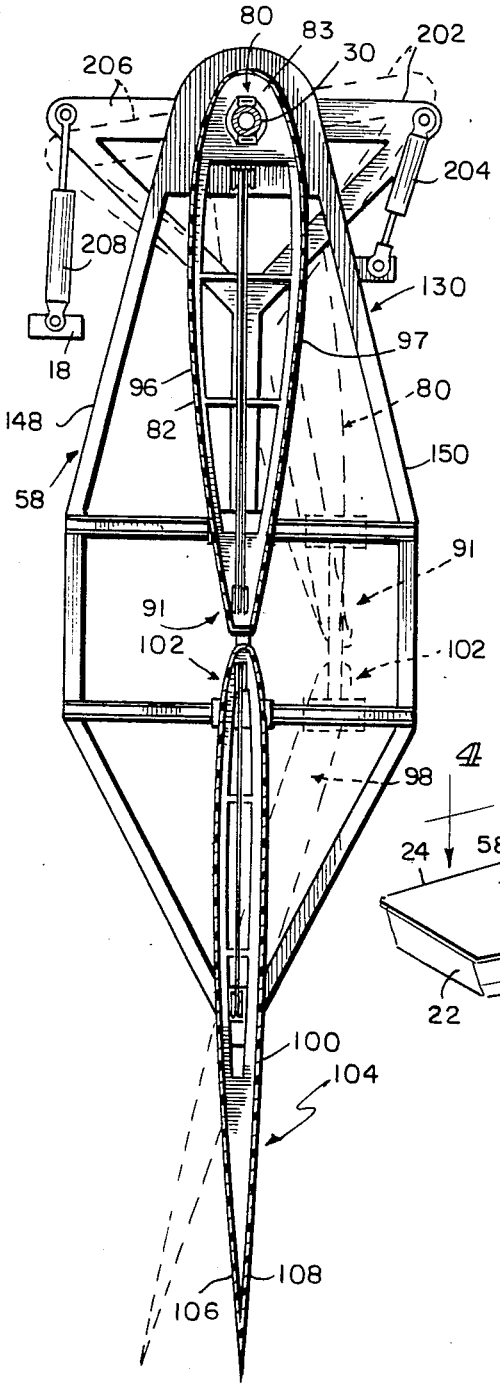
FIG. 4 is an enlarged sectional view taken generally along lines 4—4, of the sail of FIG. 1.
Figure 5:
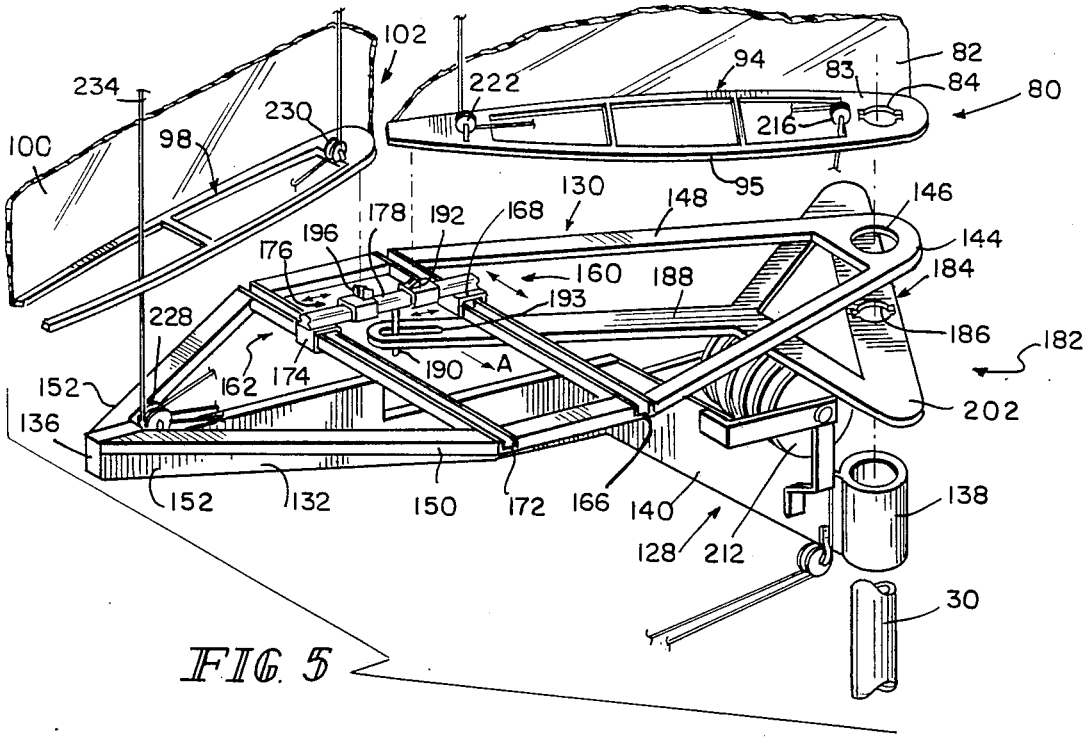
FIG. 5 is an exploded perspective view of certain details of a sail constructed according to the present invention.
Figure 6:
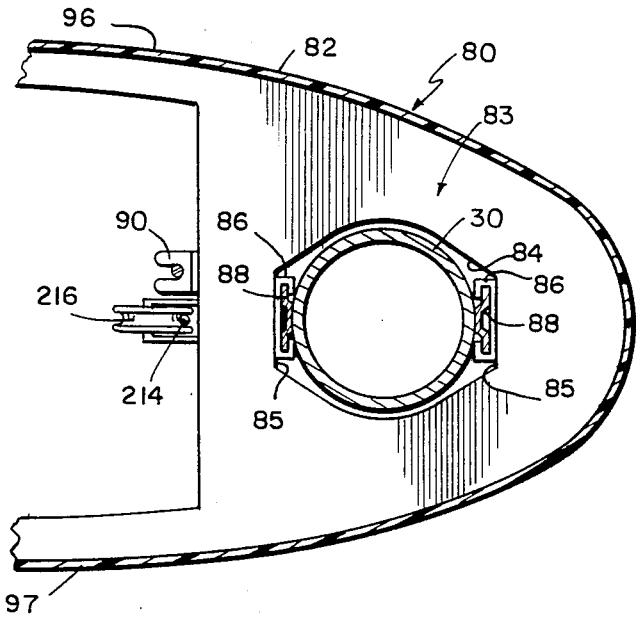
FIG. 6 is a fragmentary top plan view of an airfoil frame member constructed according to the present invention.

The front airfoil frame members 80 also include a tapered rearward portion 91 (FIGS. 4–5). Each front airfoil frame member 80 is generally symmetrical about its geometric chord so tha the side surfaces 94, 95 of the front airfoil frame members 80 are mirror images of each other. When the sail covering material 82 is applied to the front airfoil frame members 80, each of the front airfoil sections 64, 66, 68 has first and second convex airfoil surfaces 96, 97. Due to the telescoping nature of the front airfoil sections 64, 66, 68, the lengths and widths of the front airfoil frame members 80, and hence the lengths and thicknesses of the front airfoil sections 64, 66, 68 decrease between the front airfoil frame member 80 of the bottom airfoil section 66 and the front airfoil frame member of the top airfoil section 64. Preferably, however, the side surfaces 94, 95 of the front frame members 80 of all sections 64, 66, 68 have approximately the same curvature profiles, so that the curvatures of the first and second convex airfoil surfaces 96, 97 are generally constant from the bottom airfoil section 66 to the top airfoil section 64.

Tethers 99 (FIG. 3) are attached between the front airfoil frame members 80 of adjacent sections 64, 66, 68 of the front airfoil 38. The tethers prevent the sections 64, 66, 68 from becoming disengaged during the raising of the front airfoil 38.

A rear airfoil frame member 98 is provided adjacent the lower edge of each of the airfoil sections 72, 74, 76 of the rear airfoil 46. A rear airfoil frame member 98 is also provided adjacent the top edge of the top rear airfoil section 72. Sail cloth 100 is stretched over each rear airfoil frame member 98 to provide first and second convex airfoil surfaces 106, 108 for each rear airfoil section 72, 74, 76. The rear airfoil frame members 98 are generally symmetrical about their respective geometric chords.

The rear airfoil frame members 98 are generally similar to front airfoil frame members 80, in that their forward portions 102 are generally similarly shaped and their rearward portions 104 are generally tapered. The rear airfoil frame members 98, however, have somewhat thinner profiles (narrower widths) than the front airfoil frame members 80.

Additionally, the lengths of the rear airfoil frame members 98 vary somewhat more than the lengths of the front airfoil frame members 80. The rear airfoil frame member 98 of the bottom airfoil section 74 is the longest and widest, and the airfoil frame member of the top airfoil section 72 is the narrowest and shortest. Tethers 110, which are similar in design and function to tethers 99, are attached between the rear airfoil frame members 98 of adjacent sections 72, 74, 76 of the rear airfoil 46.

Figure 3:
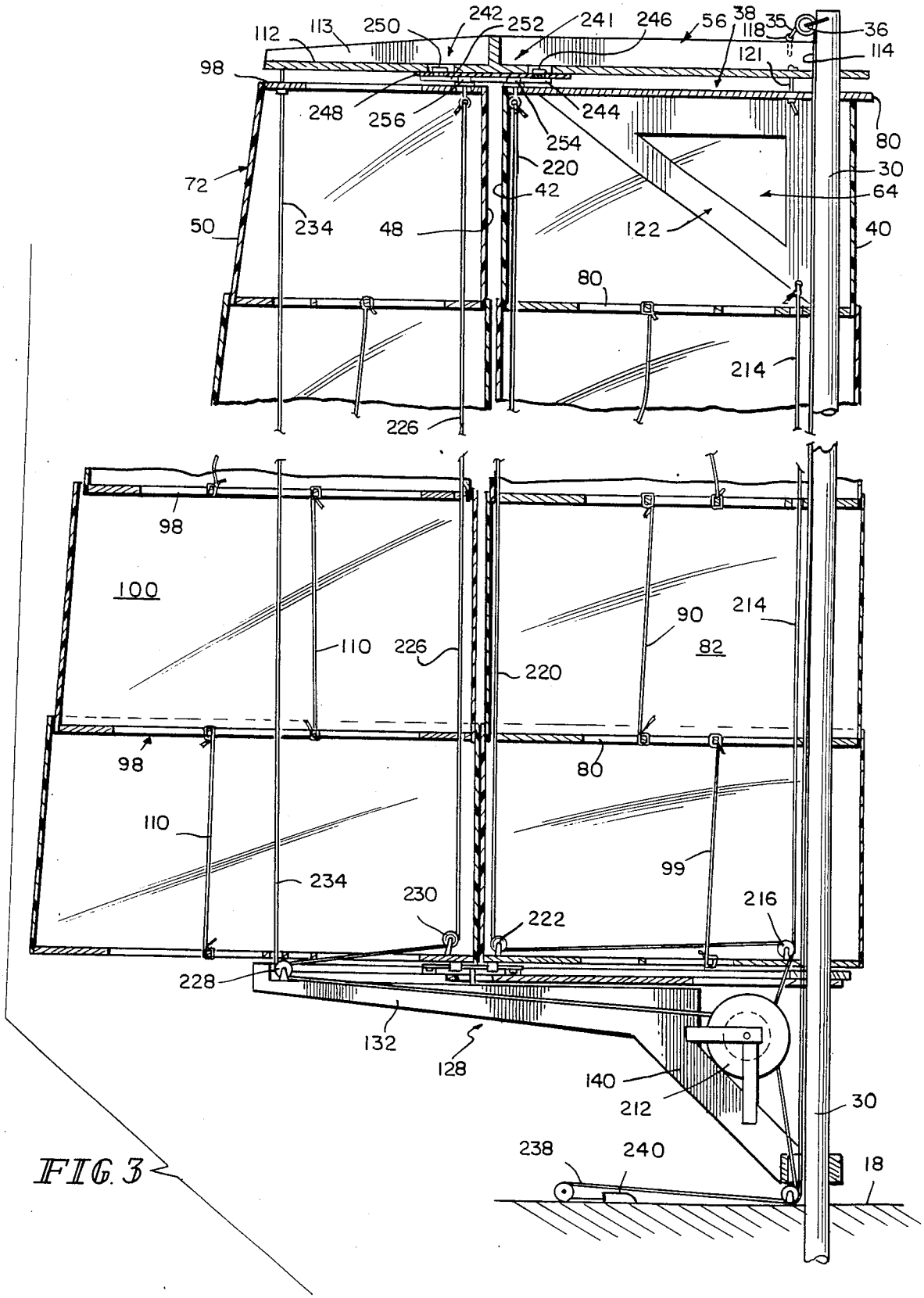
FIG. 3 is an enlarged sectional view, taken generally along section lines 3—3 of FIG. 1 of a sail system constructed according to the present invention.

The top member 56 is shown in FIG. 3 as being disposed generally above the front and rear airfoils 38, 46, and is provided for supporting the top portions of the front and rear airfoils 38, 46. The top member 56 includes a horizontally extending gaff 112. The gaff 112 is disposed generally adjacent to the tops of the top airfoil sections 64, 72 of the respective front and rear airfoils 38, 46, and extends generally between the leading edge 40 of the front airfoil 38 and the trailing edge 50 of the rear airfoil 46. A cross-brace structure 113 is provided for adding structural rigidity to the gaff 112. The top member 56 also includes a right cylindrical collar 114 which is rotatably coupled to the mast 30. The collar 114 is not keyed to the mast 30, so that the top membr 56 can rotate independently of the rotation of the mast 30.

A reinforced aperture (not shown) is provided on the cross brace structure 113 for receiving a halyard shackle 118. The halyard shackle 118 connects the halyard 35 to the top member 56. A cable 121 connects the top member 56 to the front portion 83 of the front airfoil frame member 80 adjacent the top edge of top airfoil secion 64. The connection between the halyard 35, top member 56 and top front airfoil frame member 80 permits the sailor to use the halyard 35 to raise and lower the front and rear airfoils 38, 46 up and down the mast 30. A triangularly shaped brace 122 is connected to the top front airfoil frame member 80 for maintaining the top front airfoil frame member 80 in a generally horizontal orientation. The brace 122 is disposed within the top airfoil section 64 of the front airfoil 38.

The base member 58 is shown most clearly in FIGS. 3–5. The base member 58 is disposed generally beneath the bottom airfoil sections 66, 74 of the front and rear airfoils 38, 46. The base member 58 has about the same length as the top member 56, and extends rearwardly to a point approximately two-thirds of the distance between the leading 48 and trailing 50 edges of the bottom airfoil section 74 of the rear airfoil 46. The base member 58 supports the front and rear airfoils 38, 46 above the deck 18 of the boat 12, and maintains the proper lateral orientations of the lower parts of the front and rear airfoils 38, 46.

The base member 58 includes a support arm 128 and a boom structure 130. The support arm 128 and boom structure 130 are either a unitary structure or can be separate structures which are fixed to each other.

As best shown in FIG. 5, the support arm 128 includes a horizontally extending support portion 132 which extends rerwardly as far as the boom structure 130, and terminates at a rearward end 136. The support arm 128 also includes a right cylindrical collar 138 having a cylindrical hollow interior. The collar 138 is rotatably coupled to the mast 30 to permit the support arm 128 to rotate independently of the mast 30. An angled vang portion 140 extends between the collar 138 and the support portion 132.

The boom structure 130 includes a forward portion 144 having an aperture 146 for rotatably receiving the mast 30. Aperture 146 permits the boom structure 130 to rotate independently of the rotation of the mast 30. Aperture 146 and collar 138 provide a two-point connection between the base member 58 and the mast 30. This two-point connection helps to maintain the base member 58 in a fixed orientation with respect to the mast 30, generally normal to the mast 30, regardless of the relative rotative positions of the base member 58 and mast 30. This two-point connection obviates the need for providing a separate boom vang to maintain the boom structure 130 generally normal to mast 30. The boom structure 130 further includes first and second side portions 148, 150, each of which has a rearward portion 152 joined to the rearward end 136 of the support arm 128.

A first traveller means 160 is coupled to the boom structure 130 for operatively coupling the front airfoil 38 to the boom structure 130, and hence base member 58. A second traveller means 162 is coupled to the boom structure 130 for operatively coupling the rear airfoil 46 to the boom structure 130, and hence the base member 58. The first traveller means 160 includes a first transverse traveller track 166 which extends between the first and second side portions 148, 150 of the boom structure 130,and a first traveller carriage 168 which is movable along the track between the first and second side portions 148, 150, in a direction indicated generally by arrow A. The traveller carriage 168 may include ball bearings, roller bearings, or wheels (not shown) to aid the traveller carriage 168 to move along the first transverse traveller track 166.

The second traveller means 162 includes a second transverse traveller track 172 which is disposed generally parallel to the first transverse traveller track 16, and extends between the first and second side portions 148, 150 of the boom structure 130. A second traveller carriage 174 is generally similar to the first traveller carriage 168 and is movable along the second transverse traveller track 172 between the first and second side portions 148, 150 in a direction indicated by arrow A.

A bridge member 176 having a longitudinal track 178 extends between and couples the first and second traveller carriages 168, 174, so that the first and second traveller carriages 168, 172 will move with each other along the respective first and second transverse traveller tracks 166, 172. Illustratively, the longitudinal track 178 can be a traveller track of the type manufactured by the HARKEN Corp of 1251 E. Wisconsin Ave., Pewaukee, Ws. 53072.

A camber adjustment means, such as lever arm 182, is provided for adjusting the camber angle between the front and rear airfoils 38, 46 relative to the base member 58, for permitting the user to adjust the camber of the airfoil system 10. The lever arm 182 includes a forward portion 184 having an opening 186 shaped like opening 84 (FIG. 6), which fixed arm 182 for rotation with the mast 30. The mast 30 and lever arm 182 are fixed to each other so that rotation of one of the mast 30 and lever arm 182 rotates the other of the mast 30 and lever arm 182. The lever arm 182 also includes a horizontally disposed, rearwardly extending arm 188 which extends rearwardly to a point generally between the first and second tranverse traveller tracks 166, 172.

A traveller connector pin 190 engages a slot 193 at the rearward end of arm 188. Pin 190 extends through the longitudinal slot 193 in arm 188, and is fixed to the underside of longitudinal track 178. Front and rear traveller cars 192, 196 are slidably mounted to the longitudinal track 178 for longitudinal movement along the track 178. The traveller cars 192, 196 can be similar to those traveller cars manufactured by the HARKEN Corp. of 1251 E. Wisconsin Ave., Pewaukee, Ws. 53072.

The front traveller car 196 is swivelably engaged to the rearward portion 91 of the front airfoil frame member 80 of the bottom section 66 of the front airfoil 38. The engagement of the lever arm 182, pin 190, slot 193, and front traveller car 192 causes the bridge 176 and rear portion 91 of the front airfoil frame member 80 to move in response to movement of the lever arm 182.

The rear traveller car 196 moves longitudinally on track 178 and is swivelably engaged to the forward portion 102 of the rear airfoil frame member 98 of the bottom section 74 of the rear airfoil 46. The engagement of rear traveller car 196 and rear airfoil frame member 98 causes the forward portion 102 of the rear airfoil frame member 98 to move in response to movement of the first and second traveller carriages 168, 174 and bridge 176. As discussed above, the first and second traveller carriages 168, 174 and bridge 176 move in response to movement of the lever arm 182. The coupling of the bridge 176, pin 190, front and rear traveller cars 192, 196, and front and rear airfoil frame members 80, 98, translates the movement of lever arm 182 into movement of the front and rear airfoils 38, 46. The movement of lever arm 182 causes the front airfoil frame member 80 to rotate about an axis defined by the mast 30. this rotational movement of the front airfoil frame member 80 causes a counter-rotational movement of the rear airfoil frame member 98 abouts its axis. This rotational/counter-rotational movement permits the user to adjust the angle between the geometric chords of the front and rear airfoils 38, 46, hence enabling the user to adjust the camber of the airfoil system 10.

As best shown in solid line in FIG. 4, the airfoil sail system 10 can be adjusted to a position wherein the geometric chords of the front and rear airfoils 38, 46 are generally colinear. At this position, the camber of the airfoil sail system 10 is said to be at its minimum. The airfoil sail system 10 can also be adjusted to other positions (one of which is shown in broken lines in FIG. 4) wherein the geometric chords of the front and rear airfoils 38, 46 are disposed at an angle to each other of less than 180°. In the position shown in broken lines in FIG. 4, the airfoil system 10 is said to have a relatively higher degree of camber.

First and second top traveller means 241, 242 are operatively coupled between the gaff 112 and the respective top sections 64, 72 of the front and rear airfoils 38, 46. The first and second top traveller means 241, 242 are generally similar in configuration to first and second traveller means 160, 162. The first top traveller means 241 includes a first transverse traveller track 244 which is mounted adjacent to the underside of gaff 112, and a first traveller carriage 246 which is movable along the track 244. The second top traveller means 242 includes a second transverse traveller track 248 which is mounted adjacent to the underside of gaff 112, and a second traveller carriage 250, which is movable along the track 248.

A top traveller bridge member includes a top longitudinal track 252 similar to longitudinal track 178. Top longitudinal track 252 extends between and couples the first and second top traveller carriages 246, 250. Front and rear top traveller cars 254, 256 (which can be similar to traveller cars 192, 196) are slidably mounted to top longitudinal track 252 for longitudinal movement thereon. The front top traveller car 254 is swivelably mounted to the rear portion of the top front airfoil frame member 80 for operatively coupling the front airfoil 38 to the first and second top traveller means 241, 242. The rear top traveller car 256 is swivelably mounted to the front portion of the top rear airfoil frame member 98 for opeatively coupling the rear airfoil 46 to the first and second top traveller means 241, 242.

A user-actuable mast 30 rotation means such as a first mast rotation arm portion 202 is provided for permitting the user to rotate the mast 30. The mast rotation arm portion 202 is formed as a part of the lever arm 182 so that movement of the first mast rotation arm portion 202 moves lever arm 182.

As shown in FIG. 4, an actuating means including a hydraulic cylinder 204 is coupled between the first mast rotation arm portion 202 and the second side portion 150 of the boom structure 130. The lever arm 182 also includes a second mast rotation arm portion 206. A second actuating means including a hydraulic cylinder 208 is coupled between the second mast rotation arm portion 206 and the deck 18 of the boat 12. The movement of the second mast rotation arm portion 206 relative to deck 18 by actuation of hydraulic cylinder 208 without actuation of hydraulic cylinder 204 changes the angle between the longitudinal centerline of boom structure 130 and the longitudinal centerline of the boat 12. This is how the angle of attack of the airfoil sail system 10 is adjusted. To adjust the camber of the airfoil sail system 10, hydraulic cylinders 204, 208 are actuated simultaneously. This permits relative rotational movement between lever arm 182 and the boom structure 130. This relative rotational movement causes the rearwardly extending arm 188 to move, which in turn moves the first and second traveller carriages 168, 174. The engagement of the traveller carriages 168, 174, bridge member 176, track 178, and traveller cars 192, 196, translates this movement into rotational movement of the front airfoil 38, and counter-rotational movement of the rear airfoil 46.

A five-compartment reel 212 is provided for paying out and taking up the airfoil sail system 10 control cables and a halyard 35. Four of the reel 212's five compartments are utilized by the airfoil sail system 10's four airfoil control cables 214, 220, 226, 234 (FIG. 3). The fifth compartment of the reel is provided for taking up and paying out the halyard 35. The halyard 35 is wound on the reel 212 in a direction opposite the direction in which the airfoil control cables 214, 220, 226, 234 are wound, so that when the halyard 35 is being taken up on the reel 212, the airfoil control cables 214, 220, 226, 234 are being paid out. Similarly, when the airfoil control cables 214, 220, 226, 234 are being taken up on reel 212, the halyard 35 is being paid out.

The four airfoil control cables include first and second front airfoil control cables 214, 220, respectively, and first and second rear airfoil control cables 226, 234, respectively. The first front airfoil control cable 214 extends from the reel 212 and around a two-compartment turning block 216. The front airfoil control cable 214 then extends up the mast 30 between the two-compartment turning block 216 and the triangular brace 122 of the top member 56. The two-compartment turning block 216 is mounted to the upper surface of the front portion 83 of the front airfoil frame member 80 of the bottom section 66 of the front airfoil 38.

The second front airfoil control cable 220 extends from the reel 212, and around the second compartment of the two-compartment turning block 216 to a turning block 222 mounted on the rear portion 91 of the front airfoil frame member 80 of the bottom airfoil section 66. The second front airfoil control cable 220 then extends upwardly, generally parallel to the front airfoil control cable 214. The end of the second front airfoil control cable 220 is anchored to the rear portion of the top front airfoil frame member 80. Both of the first and second front airfoil control cables 214, 220 extend interiorly of the sections 64, 66, 68 of the front airfoil 38. The first and second front airfoil control cables 214, 220 help to maintain the front airfoil 38 in its proper orientation from the top of the airfoil 38 to the bottom of the airfoil 38, to reduce luffing of the front airfoil 38.

The first rear airfoil control cable 226 extends from the reel 212 along the support arm 128 and around a two-compartment turning block 228 mounted to the support arm structure 128, adjacent its rearward end 136. From turning block 228, the first rear airfoil control cable 226 extends to, and passes around, a turning block 230 disposed on the forward portion 102 (FIG. 5) of the rear airfoil frame member 98 of the bottom section 74 of the rear airfoil 46. The first rear airfoil control cable 226 then extends generally parallel to the leading edge 48 of the rear airfoil 46, and has its end attached to the forward portion of the top rear airfoil frame member 98.

The second rear airfoil control cable 234 extends along support arm 128 around the turning block 228 and upwardly, generally parallel to first rear airfoil control cable 226. The second rear airfoil control cable 234 has its end attached to the rearward portion of gaff 112. In addition to controlling the orientation of the rear airfoil 46, the second rear airfoil control cable 234 provides the axis about which the rear airfoil 46 counter-rotates in response to the rotation of the front airfoil 38.

A tensioning loop 238 is provided in the portion of the halyard 35 that is lead to a cleat 240 on deck 18 for user control.

Figure 7:
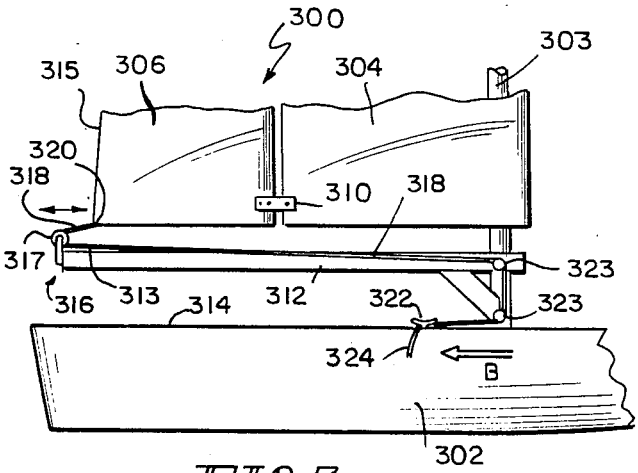
FIG. 7 is a perspective view of another embodiment of an airfoil sail system constructed according to the present invention.

An airfoil sail system 300 is shown in FIG. 7. Airfoil system 300 is used for propelling a boat 302, which may be similar to boat 12 shown in FIGS. 1 and 2. The airfoil sail system 300 is camberable, but not reefable, and is therefore especially adaptable for smaller boats which ordinarily are not piloted far enough out into open water to require reefing capabilities.

Boat 302 includes a rotatable mast 303 which is generally similar to rotatable mast 30. The front and rear airfoils 304, 306 are generally similar in shape and configuration to the front and rear airfoils 38, 46 shown in FIGS. 1–6, except that front and rear airfoils 304, 306 each comprise a single section, and not a plurality of telescoping sections, such as the plurality of telescoping sections 64, 66, 68, 72, 74, 76 from which the airfoils 38, 46 of the embodiment shown in FIGS. 1–6 are made.

The front and rear airfoils 304, 306 are camberable. Several tabs 310 operatively couple the trailing edge of the front airfoil 304 to the leading edge of the rear airfoil 306. Through this arrangement, the rotation of front airfoil 304 effects a counter-rotation of rear airfoil 306.

A boom 312 is disposed between the lower edges of the front and rear airfoils 304, 306, and the deck 314 of the boat 302. The boom 312 is disposed horizontally and includes an aft portion 313 which extends rearwardly beyond the trailing edge 315 of the rear airfoil 306. An outhaul means 316 is provided for permitting the sailor to adjust the camber of the airfoil sail system 300. The outhaul means 316 comprises a pulley 317 disposed adjacent the rearward end of the boom 312 and an outhaul line 318 which has one end 320 attached to the clew of the trailing edge 315 of the rear airfoil 306, and passes around pulley 317. The outhaul line 318 extends along the boom 312, down mast 303, and around pulleys 323, to a cleat 322 which is fixed to the boat 302.

The user adjusts the camber of the sail system 300 by adjusting the tension of the outhaul means 316. By pulling on the second end 324 of the outhaul line 318 in a direction indicated generally by arrow B, the tension exerted by the outhaul means 316 on the front and rear airfoils 304, 306 is increased. Through the engagement of the outhaul line 318 and rear airfoil 306, the rear airfoil 306 is moved rearwardly in a direction generally opposite to that indicated by arrow B. This rearward movement of rear airfoil 306 causes the camber of the airfoil sail system 300 to be decreased. To increase the camber of the airfoil sail system 300, the tension on the outhaul means 316 is reduced by allowing end 324 to move in a direction opposite to that indicated by arrow B. The force of the wind against the front and rear airfoils 304, 306 causes the rear airfoil 306 to move in a direction genrerally opposite that indicated by arrow B. The engagement of the front and rear airfoils 304, 306 through tab members 310, will translate this forward movement of the rear airfoil 306 into rotational movement of the front airfoil 304 about a vertical axis defined generally by mast 303, and somewhat counter-rotational movement of rear airfoil 306.

Figure 8:
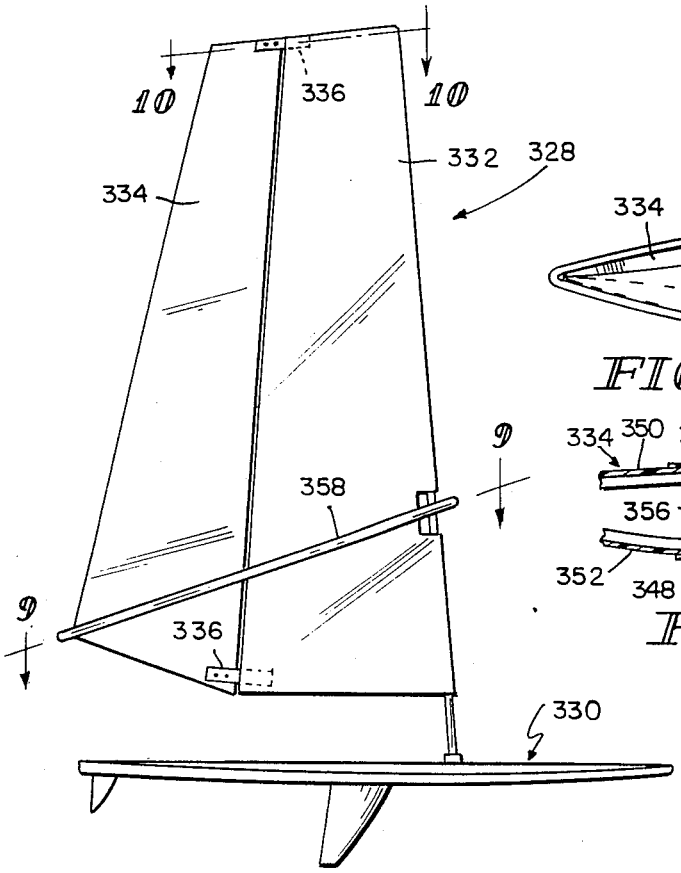
FIG. 8 is a side elevational view of another embodiment of an airfoil sail system constructed according to the present invention.

An airfoil sail system 328 which is adapted for use with a sailboard 330 is shown in FIG. 8. The airfoil sail system 328 includes a front airfoil 332 and a rear airfoil 334. The profiles of the front and rear airfoils 332, 334 are generally similar to the front and rear airfoils 38, 46 shown in FIGS. 1–6. The front and rear airfoils 332, 334 of the embodiment shown in FIG. 8 are non-reefable, similar to the front and rear airfoils 304, 306 shown in FIG. 7.

Figure 10:
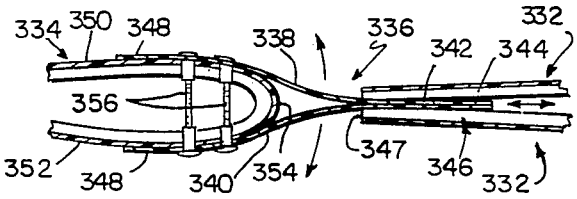
FIG. 10 is a fragmentary sectional view taken generally along section lines 10—10 of FIG. 8.

The means 336 for operatively coupling the front and rear airfoils 332, 334 is best shown in FIG. 10. Each means 336 for operatively coupling to the front and rear airfoils 332, 334 includes strips of material 338, 340. The strips 338, 340 each include a first end 342 which is received interiorly of the front airfoil 332. The first ends 342 are attached to the rearward portion 344 of the front airfoil frame members 346 and extend outwardly and rearwardly from the trailing edge 347 of the front airfoil 332. The first and second sheets of material 338, 340 also each include second ends 348, which are disposed adjacent the respective first and second airfoil surfaces 350, 352 of the rear airfoil 334, adjacent the leading edge 354 of the rear airfoil 334. Bolts 356 or rivets (not shown) are provided for anchoring the second ends 348 of the first and second sheets of material 338, 340 to secure the second ends 348 to the rear airfoil 334.

Figure 9:
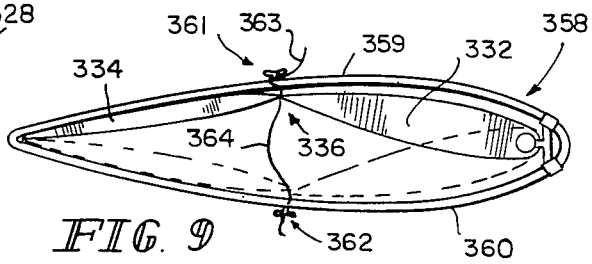
FIG. 9 is a fragmentary sectional view taken generally along section lines 9—9 of FIG. 8.

The sailboard 330 shown in FIG. 8 includes a wishbone boom 358 which is disposed between the top and bottom edges of the front and rear airfoils 332, 334. The wishbone boom 358 is gripped by the sailor to enable the sailor to maintain himself on the sailboard 330. As best shown in FIG. 9, the wishbone boom 358 includes a first leg 359 disposed on the port side of the front and rear airfoils 332, 334, and a second leg 360 disposed on the starboard side of the front and rear airfoils The airfoils 332, 334 are placed interiorly of the legs 359, 360 of wishbone boom 358.

A first cleat 361 is disposed on the first leg 359 and a second cleat 362 is disposed on the second leg 360. A first camber control line 363 is coupled at one end to either the trailing portion of the front airfoil 332, the leading portion of the rear airfoil 334 or the means 336 for coupling the front and rear airfoils 332, 334. The first camber control line 363 is engageable with the first cleat 361 to permit the user to set the camber of the airfoil sail system 328 when the sailboard 330 is on a port tack. A second camber control line 364 is coupled at one end to either the trailing portion of the front airfoil 332, the leading portion of the rear airfoil 334 or the means 336 for coupling the front and rear airfoils 332, 334. The second camber control line 364 is engageable with the second cleat 362 to permit the user to set the camber of the airfoil sail system 328 when the sailboard 330 is on a starboard tack.

Figure 11:
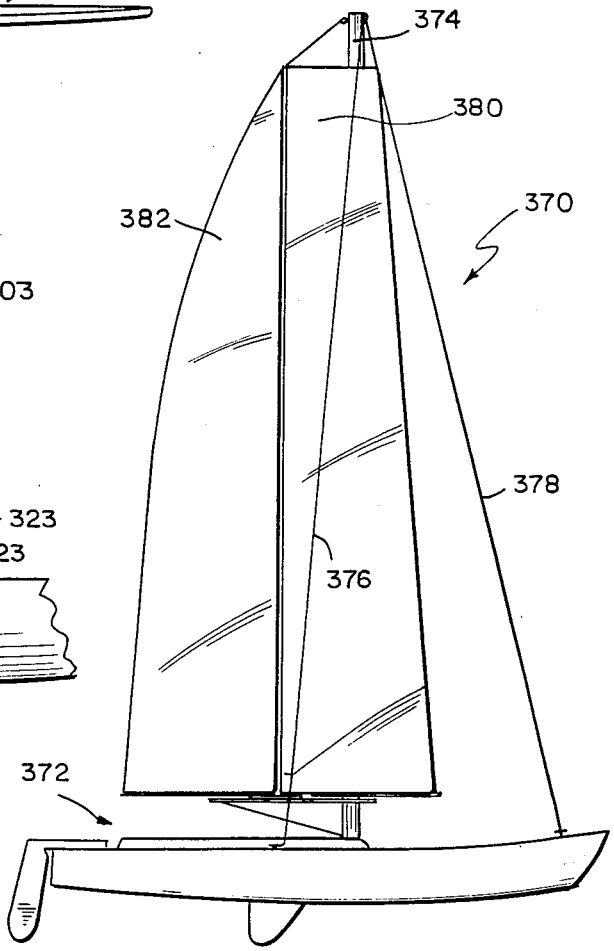
FIG. 11 is a side elevational view of another embodiment of an airfoil sail system constructed according to the present invention.

An airfoil sail system 370 which is adapted for use on a catamaran 372 is shown in FIG. 11. The catamaran 372 shown in FIG. 11 includes a rotatable mast 374 which is maintained in its upright position by two or more shroud lines 376 and a forestay 378. The airfoil sail system 370 includes a front airfoil 380 and a rear airfoil 382 which are generally similar in design configuration to the front and rear airfoils 304, 306 shown in FIG. 7.

What is claimed is:

1. An airfoil sail system for a boat having a mast, the airfoil sail system comprising a front airfoil pivotable about an axis defined by the mast, the front airfoil having a leading edge and a trailing edge and being generally symmetrical about a vertical plane extending between the leading and trailing edges, the front airfoil comprising a plurality of telescoping front airfoil sections, a rear airfoiil having a leading edge and a trailing edge and being pivotable about an axis defined between its leading and trailing edges, the rear airfoil being gnerally symmetrical about a vertical plane extending between the leading and trailing edges, the rear airfoil comprising a plurality of telescoping rear airfoil sections, the front and rear airfoil sections telescoping to permit reefing of the front and rear airfoils, and operative coupling means for opeatively coupling the front and rear airfoils so that rotation of the front airfoil about its axis effects a counter-rotation of the rear airfoil about its axis to permit adjustment of the camber of the sail system.

2. The airfoil sail system of claim 1 further comprising a base member disposed beneath the front and rear airfoils, the front and rear airfoils mounted on the base member to be movable with the base member to permit the user to adjust the angle of attack of the sail system, and movable relative to the base member to permit the user to adjust the camber of the sail system.

3. The airfoil sail system of claim 2 wherein the mast is rotatably coupled to the boat, the front airfoil is fixed to the mast for rotation with the mast and the rear airfoil is rotatably coupled to the base member.

4. The airfoil sail system of claim 1 further comprising a base member disposed beneath the front and rear airfoils, a top member disposed above the front and rear airfoils, at least one front airfoil controlcable extending interiorly of the front airfoil between the top and base members, and at leat one rear airfoil control cable extending interiorly of the rear airfoil between the top and base members.

5. An airfoil sail system for a boat having a mast, the airfoil sail system comprising a front airfoil pivotable about an axis defined by the mast, the front airfoil having a leading edge and a trailing edge and being generally symmetrical about a vertical plane extending between the leading and trailing edges, a rear airfoil having a leading edge and a trailing edge, the rear airfoil being generally symmetrical about a vertical plane extending between the leading and trailing edges, operative coupling means for operatively coupling the front and rear airfoils so that rotation of the front airfoil about its axis effects a counter-rotation of the rear airfoil to permit adjustment of the camber of the sail system, the front airfoil comprising a plurality of telescoping front airfoil sections, the rear airfoil comprising a plurality of telescoping rear airfoil sections, the front and rear airfoil sections telescoping to permit reefing of the front and rear airfoils, a base member disposed beneath the front and rear airfoils, a top member disposed above the front and rear airfoils, at least one front airfoil control cable extending interiorly of the front airfoil between the top and base members, and at least one rear airfoil control cable extending interiorly of the rear airfoil between the top and base members, the rear airfoil control cable defining an axis about which the rear airfoil counter-rotates in response to rotation of the front airfoil.

6. An airfoil sail system for a boat having a mast, the airfoil sail system comprising a front airfoil privotable about an axis defined by the mast, the front airfoil having a leading edge and a trailing edge and being generally symmetrical about a vertical plane extending between the leading and trailing edges, a rear airfoil having a leading edge and a trailing edge and being pivotable about an axis defined between its leading and trailing edges, the rear airfoil being genrally symmetrical about a vertical plane extending between the leading and trailing edges, a top member disposed above the front and rear airfoils and a base member disposed below the front and rear airfoils, the front and rear airfoils each comprising a plurality of telescoping airfoil sections including a bottom airfoil section disposed above and adjacent to the base member, a top airfoil section connected to the top member and at least one intermediate airfoil section disposed between the top and bottom airfoil sections, the airfoil sections of the front and rear airfoils telescoping to permit reefing of the front and rear airfoils, and operative coupling means for operatively coupling the front and rear airfoils so that rotation of the front airfoil about its axis effects a counter-rotation of the rear airfoil about its axis to permit adjustment of the camber of the sail system.

7. The airfoil sail system of claim 6 wherein the mast is rotatable relative to the boat, said intermediate airfoil section includes a top and a bottom, an airfoil frame member disposed adjacent the bottom of the intermediate airfoil section for imparting an airfoil profile to the intermediate airfoil section, the airfoil frame being coupled for rotation with the mast and for movement longitudinally to the mast up and down the mast during the raising and lowering of the intermediate airfoil section.

8. An airfoil sail system for a boat having a mast, the airfoil sail system comprising a front airfoil pivotable about an axis defined by the mast, the front airfoil having a leading edge and a trailing edge and being generally symmetrical about a vertical plane extending between the leading and trailing edges, a rear airfoil having a leading edge and a trailing edge, the rear airfoil being genrally symmetrical about a vertical plane extending between the leading and trailing edges, operative coupling means for operatively coupling the front and rear airfoils so that rotation of the front airfoil about its axis effects a counter-rotation of the rear airfoil to permit adjustment of the camber of the sail system, a base member disposed generally between the front and rear airfoils and the boat, said operative coupling means including first traveller means disposed on said base member adjacent the front airfoil and second traveller means disposed on the base member adjacent the rear airfoil, the first traveller means including a transverse traveller track fixed to the base member adjacent the trailing edge of the front airfoil, a traveller carriage movable along the transverse traveller track, and traveller connector means for connecting the traveller carriage to the front airfoil, and the second traveller means including a transverse traveller track fixed to the base member adjacent the leading edge of the rear airfoil, a traveller carriage movable along the transverse traveller track and traveller connector means for connecting the traveller carriage to the rear airfoil.

9. The airfoil sail system of claim 8 wherein the base member is rotatably coupled to the mast, the mast is rotatable relative to the boat and each of the front and rear airfoils includes a bottom airfoil frame member disposed adjacent the base member and movable relative to the base member, further comprising a lever arm having a first end portion fixed to the mast for rotation therewith and a second end portion coupled to the first traveller means for moving its traveller carriage along its traveller track.

10. An airfoil sail system for a boat having a mast, the airfoil sail system comprising a generally rigid front airfoil rotatable about an axis defined by the mast, the front airfoil having a leading edge, a trailing edge, and first and second convex airfoil surfaces extending between the leading edge and the trailing edge, the front airfoil being generally symmetrical bout a vertical plane defined by the geometric chord of the front airfoil, the front airfoil comprising a plurality of telescoping front airfoil sections, a generally rigid rear airfoil rotatable about an axis defined between its leading and trailing edges, the rear airfoil having a leading edge, a trailing edge and first and second convex airfoil surfaces extending between the leading edge and the trailing edge, the rear airfoil being generally symmetrical about a vertical plane defined by the geometric chord of the rear airfoil, the rear airfoil comprising a plurality of telescoping rear airfoil sections, the front and rear sections telescoping to permit reefing of the front and rear airfoils, and operative coupling means for opeatively coupling the front and rear airfoils so that rotation of the front airfoil about its axis effects counter-rotation of the rear airfoil about its axis to adjust the camber of the airfoil system.

* * * * *

UNITED STATES PATENT AND TRADEMARK OFFICE

CERTIFICATE OF CORRECTION

PATENT NO. : 4,685,410

DATED : August 11, 1987

INVENTOR(S) : Robert R. Fuller

It is certified that error appears in the above-identified patent and that said Letters Patent is hereby corrected as shown below:

On the bibliography page after item [76] and before item [21] please insert --[73] Assignee: Advanced Sail Concepts, Inc., Marshfield, Massachusetts--.

Signed and Sealed this

Second Day of February, 1988

*Attest:*

DONALD J. QUIGG

*Attesting Officer*

*Commissioner of Patents and Trademarks*